US012297628B2

(12) United States Patent
Tueller et al.

(10) Patent No.: US 12,297,628 B2
(45) Date of Patent: May 13, 2025

(54) SMART FAUCET CONTROLLER AND METHOD

(71) Applicants: Steven Wayne Tueller, Laie, HI (US); Jason Scott Earl, Santa Barbara, CA (US)

(72) Inventors: Steven Wayne Tueller, Laie, HI (US); Jason Scott Earl, Santa Barbara, CA (US)

( * ) Notice: Subject to any disclaimer, the term of this patent is extended or adjusted under 35 U.S.C. 154(b) by 340 days.

(21) Appl. No.: 18/092,530

(22) Filed: Jan. 3, 2023

(65) Prior Publication Data

US 2024/0218637 A1 Jul. 4, 2024

(51) Int. Cl.

| | |
|---|---|
| ***F24H 15/325*** | (2022.01) |
| ***E03B 7/04*** | (2006.01) |
| ***F24D 17/00*** | (2022.01) |
| ***F24D 19/10*** | (2006.01) |
| ***F24H 15/175*** | (2022.01) |

(Continued)

(52) U.S. Cl.

CPC ..... *E03B 7/045* (2013.01); *F24D 17/0078* (2013.01); *F24D 19/1051* (2013.01); *F24H 15/175* (2022.01); *F24H 15/212* (2022.01); *F24H 15/325* (2022.01); *F24H 15/335* (2022.01)

(58) Field of Classification Search

CPC ..... E03B 7/045; F24H 15/325; F24H 15/335; F24H 15/212; F24H 15/175; F24D 17/0078; F24D 19/1051

See application file for complete search history.

(56) References Cited

U.S. PATENT DOCUMENTS

| | | | | |
|---|---|---|---|---|
| 4,936,289 | A | 6/1990 | Peterson | |
| 11,713,562 | B1 * | 8/2023 | Kuster | F24D 19/1051 236/12.13 |
| 2009/0145490 | A1 | 5/2009 | Kershisnik | |

(Continued)

FOREIGN PATENT DOCUMENTS

| | | | |
|---|---|---|---|
| EP | 1850202 | A1 | 10/2007 |
| ES | 2607058 | T3 | 3/2017 |
| WO | WO2010034866 | A1 | 4/2010 |

OTHER PUBLICATIONS

EvaDrop PDF, publication date unknown.

(Continued)

*Primary Examiner* — P. Macade Nichols
(74) *Attorney, Agent, or Firm* — Gary J. Cunningham

(57) ABSTRACT

A smart faucet controller (400) and method (100), comprising the steps of: detecting water movement (102); sensing water temperature (104); and processing data created by the detecting and sensing steps and sending instructions (106) to: close an exit valve to disallow water from exiting a delivery point if water is below a minimum threshold temperature, substantially simultaneously open a bypass valve to allow water to circulate back through water lines to a hot water source, activate a remote water circulation pump to send heated water to a point of use, and reset the exit valve and bypass valve to default positions and turn off a water circulation pump once the water reaches the threshold temperature. Advantageously, the method (100) and smart faucet controller (400) are configured to provide and/or measure a water conservation function that avoids wasting water.

20 Claims, 8 Drawing Sheets

(51) Int. Cl.
*F24H 15/212* (2022.01)
*F24H 15/335* (2022.01)

(56) References Cited

U.S. PATENT DOCUMENTS

2009/0230200 A1* 9/2009 Kempf ..... E03B 7/09
137/337
2019/0277011 A1* 9/2019 Doss ..... E03B 7/075

OTHER PUBLICATIONS

Faucet by iHouse, PDF, publication date unknown.
Save Water-Savinf Faucets PDF, publication date unknown.
Rheem On-Demand Standard Push Button Website PDF, publication date unknown.
Rinnai Timer Controller PDF, publication date unknown.
Rinnani—Tankless Water Heaters Website PDF, publication date unknown.
Smart Shower, Smart Home, MOEN Website PDF, publication date unknown.
Tankless Recirculation Accessories, Rinnai Website PDF, publication date unknown.

* cited by examiner

SMART FAUCET CONTROLLER AND METHOD

FIELD OF THE INVENTION

This invention relates to water usage, and more particularly to a smart faucet controller and method for the conservation of water.

BACKGROUND OF THE INVENTION

The U.S. Department of Energy reports that between 400 billion and 1.3 trillion gallons of water are wasted every year by households waiting for running water to warm up[1]. In addition, the DOE estimates that 800 to 1,600 kilowatt-hours per year are used to treat and pump the water to households that will eventually be wasted while the occupant waits for tap water to warm to the desired temperature. (See for NACHI.org International Association of Certified Home Inspectors. Hot Water Recirculation Systems https://www.nachi.org/hot-water-recirculation-systems.htm). This is a tremendous waste of natural resources and energy every year! While there are some hot water recirculation products meant to address this problem, most are designed to provide comfort and convenience with water conservation as an afterthought. When water conservation is the primary goal, the product design is different.

There are products currently on the market purportedly designed to solve the problem of unheated water arriving at the use point when hot water is desired. For example, hot water recirculating systems (https://www.bonney.com/2016/05/does-it-take-too-long-for-your-shower-to-heat-up-bonney-has-the-solution/, or https://besthotwaterrecirculators-.com/hot-water-pumps-101/) and even more high-tech solutions which involve electronic temperature https://Youtube/0MpOuGobx8I are currently available.

In the first solution, the pump requires a timer to activate it. Some pumps also have built in technology to "learn" the peak hot water use times. In either case, energy is wasted if unused hot water is circulated through the system. Additionally, this approach does not accommodate the one-off, atypical times hot water may be needed, leaving the original problem unsolved in those instances.

In the second solution, water runs until the desired temperature is reached and then the shower turns off as an indication the desired temperature has been reached. In both cases, either energy or potable water is wasted.

Another option uses motion sensing technology to activate a pump https://www.rinnai.us/residential/tankless-water-heaters/recirculation-acccssories. A motion sensor activates when movement near the faucet is sensed, but not all motion near the faucet equals a demand for hot water. Motion may activate the pump when people have no intention of using the hot water, wasting electricity and circulating water when it is not needed.

There is a need to eliminate or minimize the unnecessary use/waste of clean water in more efficient and effective ways that are cost effect, uncomplicated in design, intuitive to operate, easy to install, robust and have portable footprints.

Thus, there is a need for the development of new technologies and products to conserve water in common, everyday settings.

DESCRIPTION OF A PREFERRED EMBODIMENT

In its simplest form, a method 100, system and smart faucet controller 400 are disclosed. They can simply disallow water from exiting a spout of a faucet, shower and the like until a minimum desired water temperature is available at a point of use. This can be accomplished by installing a substantially self-contained smart faucet controller between hot and cold water lines of a faucet, shower and the like. The smart faucet controller can include a sensor/detector that discerns when water movement begins, a sensor that reads water temperature, and a processor that processes data created by the two sensors and sends wireless instructions to: close a valve to disallow water from exiting the faucet if the water is not warm enough, simultaneously open a second valve to allow water to circulate back through the water lines to the hot water source, activate a remote, existing water circulation pump to send heated water to the point of use, and reset both valves to their default positions and turn off the water circulation pump once the water reaches the desired pre-set temperature.

Upon actuation by a user, for example, via a faucet or shower handle, or remotely by a cellphone, the system can initiate a circulation pump when hot water is summoned. The system eliminates the waste of clean, unused potable water from flowing down the drain simply because it is the wrong temperature. This system is designed to interface with substantially conventional products but controls and operates them in a new way.

Figure 1:
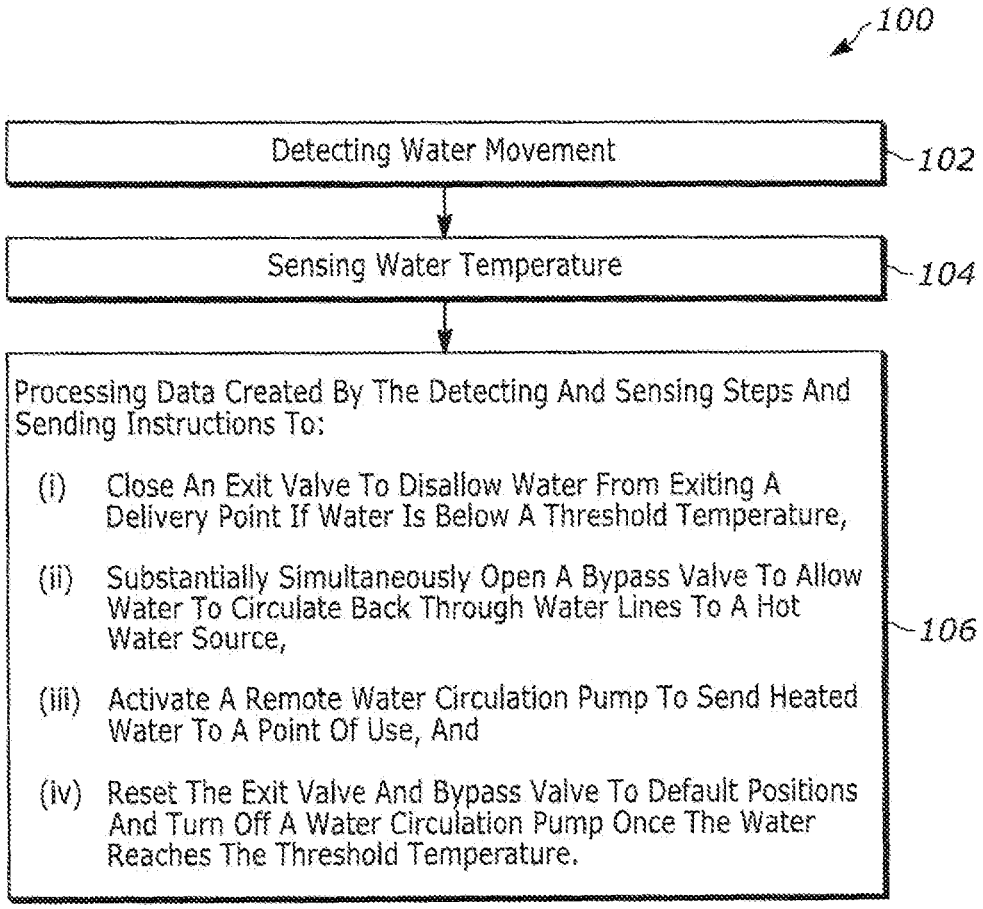
FIG. 1 is a block diagram of an embodiment of a smart faucet controlling method in accordance with the instant invention.

Referring to FIG. 1, an exemplary smart faucet controlling method 100 is shown. It can include the steps of: detecting water movement 102; sensing water temperature 104; and processing data created by the detecting and sensing steps and sending instructions 106 to: close an exit valve to disallow water from exiting a delivery point if water is below a threshold temperature, substantially simultaneously open a bypass valve to allow water to circulate back through water lines to a hot water source, activate a remote water circulation pump to send heated water to a point of use, reset the exit valve and bypass valve to default positions and turn off a water circulation pump once the water reaches the threshold temperature.

Advantageously, the method 100 is configured to provide a water conservation function and avoids wasting water. Stated differently, the method 100 can include steps that can provide a cycle to attain a desired threshold temperature before being delivered for use, without wasting or running water down a drain as in a conventional faucet or shower, for example, to attain a desired temperature.

In addition, the method 100 is intuitive so a user does not have to perform unnecessary steps, carefully read an owner's manual or do anything unusual to initiate. In one embodiment, during normal use of a faucet or shower, it simply works without any additional effort by the user.

Advantageously, no additional waiting time for hot water is required and substantially no water is wasted during the process. In more detail, once water is summoned, the sensing continues and can provide appropriate instruction to valves and a circulation pump/engine until it is no longer needed (a desired temperature threshold is reached). Advantageously, the method 100 provides a solution to wasting water and energy that simply disallows water from exiting a spout of a faucet, shower or the like until a desired threshold water temperature is attained at a point of use. In one use case, the method 100 and smart faucet controller 400 can be installed and embodied in a substantially self-contained housing between a hot and cold water line of a faucet, shower and the like. As shown in FIG. 1, the detecting step 102, the sensing step 104 and the processing and sending instructions step 106 can define a temperature conditioning cycle to attain a desired water temperature before permitting the delivery of water to exit a delivery point. Advantageously, the method 100 avoids the undesirable process of wasting water down a drain and the temperature conditioning cycle is no longer than the duration of time spent waiting for heated water to arrive as it runs down the drain.

In one embodiment, the delivery point can include at least one of a faucet spout, faucet hose and shower head. Thus, the method 100 can have application to minimize water waste in any location, public or private, where hot water is delivered such as a kitchen sink, bathroom sink, shower, bathtub, dishwasher, clothes washing machine, bidet, hot tub and the like, and at a business and/or commercial environment.

The method 100 can further comprise providing a user interface to allow substantially instant activation of a temperature conditioning cycle and deactivation returning to a default condition. Advantageously, an instant activation provides an on-demand function. And, an instant deactivation (default) function, allows a faucet or shower head to work in a conventional manner, without the water conservation function. For example, if power is lost or there is a battery failure, the faucet controller can remain in a default state and continue to be usable in a conventional manner without a water conservation function. In one embodiment of method 100, the processing and sending instructions step 106 can include providing a programing instruction to allow activation of a temperature conditioning cycle and deactivation returning to a default condition, when certain conditions are met. The default condition can allow the faucet to work as normal, for example, if power is lost or there is a battery failure, the faucet controller could remain in a default state and continue to be usable in a conventional or manual operation. In another example, if the water source does not attain a desired threshold temperature for a certain period, the programing instruction can deactivate the temperature conditioning cycle to return to a default condition, possibly because of a hot water heater malfunction.

In FIG. 1, the method 100 can further comprise actuating a temperature conditioning cycle, in various ways, such as by a mechanical switch, electrical switch, electro-mechanical switch, electronic signaling, RF signaling, cellphone signaling, portable phone signaling, tablet and/or PC signaling via Wi-Fi, for example, and the like. Advantageously, the actuating step provides a wide array of choices for a user. It can be implemented by any number of ways, as detailed above as well as by a mechanical rotation of a faucet handle to an on position, an electrical/electronic switch, toggle switch, a remote control or cellphone signal, a touchscreen display, keyboard, on-off switch, temperature setting buttons, etc. either integrated in the method 100 or smart faucet controller 400, or remotely.

In FIG. 1, the method 100 can further comprise providing an integrated or remote user interface to allow a user to control, monitor or program an operation in connection with a faucet controller, by for example, use of a touchscreen display, keyboard, on-off switch, temperature setting buttons integrated in the smart faucet controller 400 or connected remotely for a user's control. For example, a user interface with a touch screen display can be located near a water station or remote, as shown in the FIG. 3.

In FIG. 1, the method 100 can further comprise providing a processor including at least one of a user interface module, a display module, a control module, an analytics module, a historical use module, an audio module, a diagnostic module and an artificial intelligence module.

In an exemplary embodiment, the user interface allows a user choice and simplified programming, pre-setting and/or customizing of a smart faucet controller or method 100. A touch screen display can alert a user that there is no Wi-Fi signal, that a hot water heater/source is not warming up water to a desired threshold temperature, etc. and thus can quickly return to a default setting to manually operate a faucet. Also, an audio module can provide alerts for malfunctioning, receive audio commands, alert absence of Wi-Fi presence and the like.

In FIG. 1, the method 100 can further comprise providing a faucet controller operable by a user being configured to control, program and process data provided by the detecting step 102 and sensing step 104, the faucet controller being connected to a detector and the sensor. Advantageously, the faucet controller can facilitate the operation of the water conservation function and can be strategically located as well in proximity to a water usage station.

Figure 4:
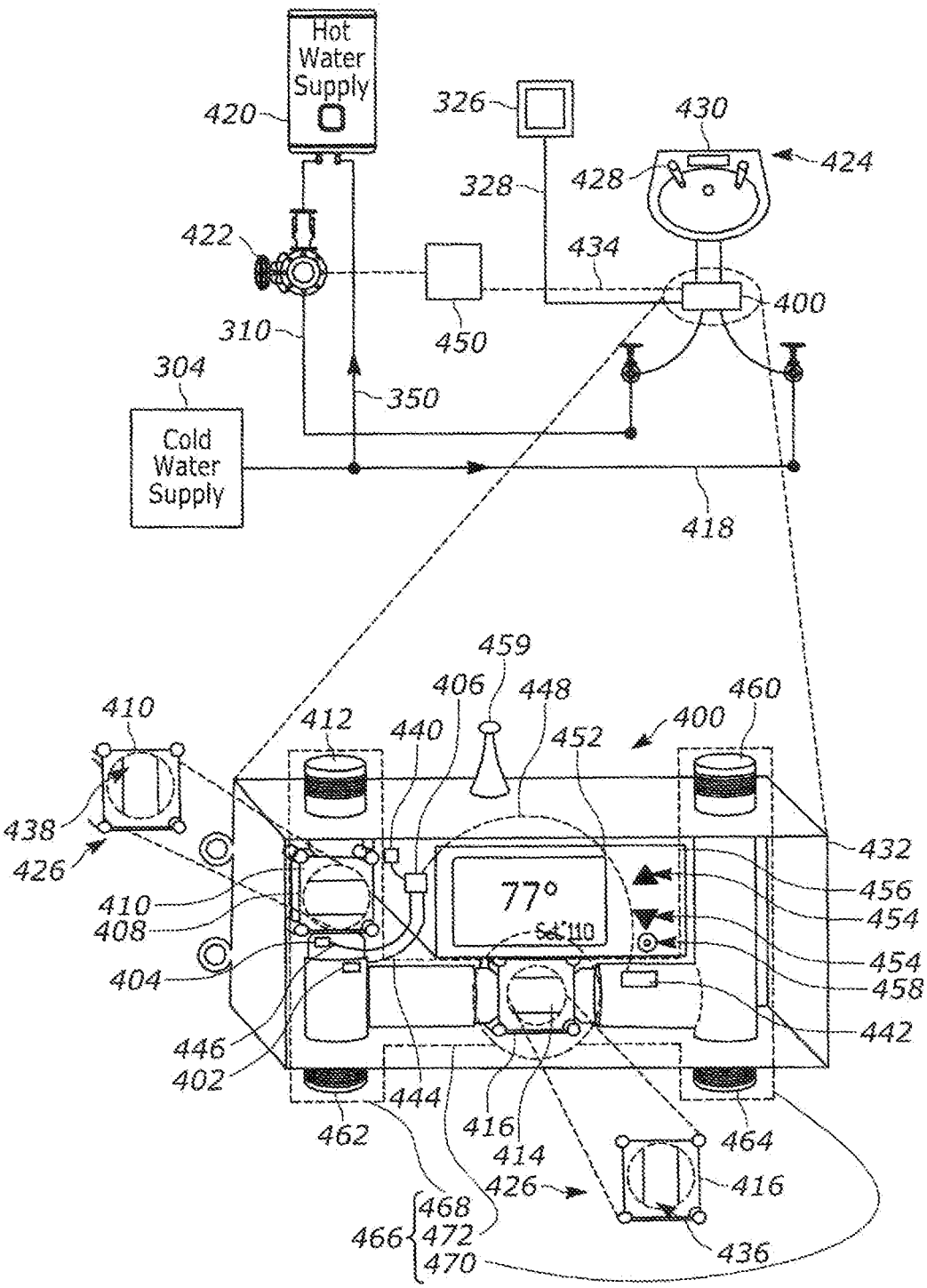
FIG. 4 is an embodiment of a smart faucet controller in accordance with the instant invention.

In FIG. 1, the method 100 can include providing a water flow sensor (such as item 442 in FIG. 4). Advantageously, this feature can provide water usage information and/or savings, for example. This can easily be displayed, so a user can measure and gain data in connection with water savings usage, possibly historically within a desired time. In one embodiment, it can be a Hall Sensor for providing reliable data and robust operation.

Figure 2:
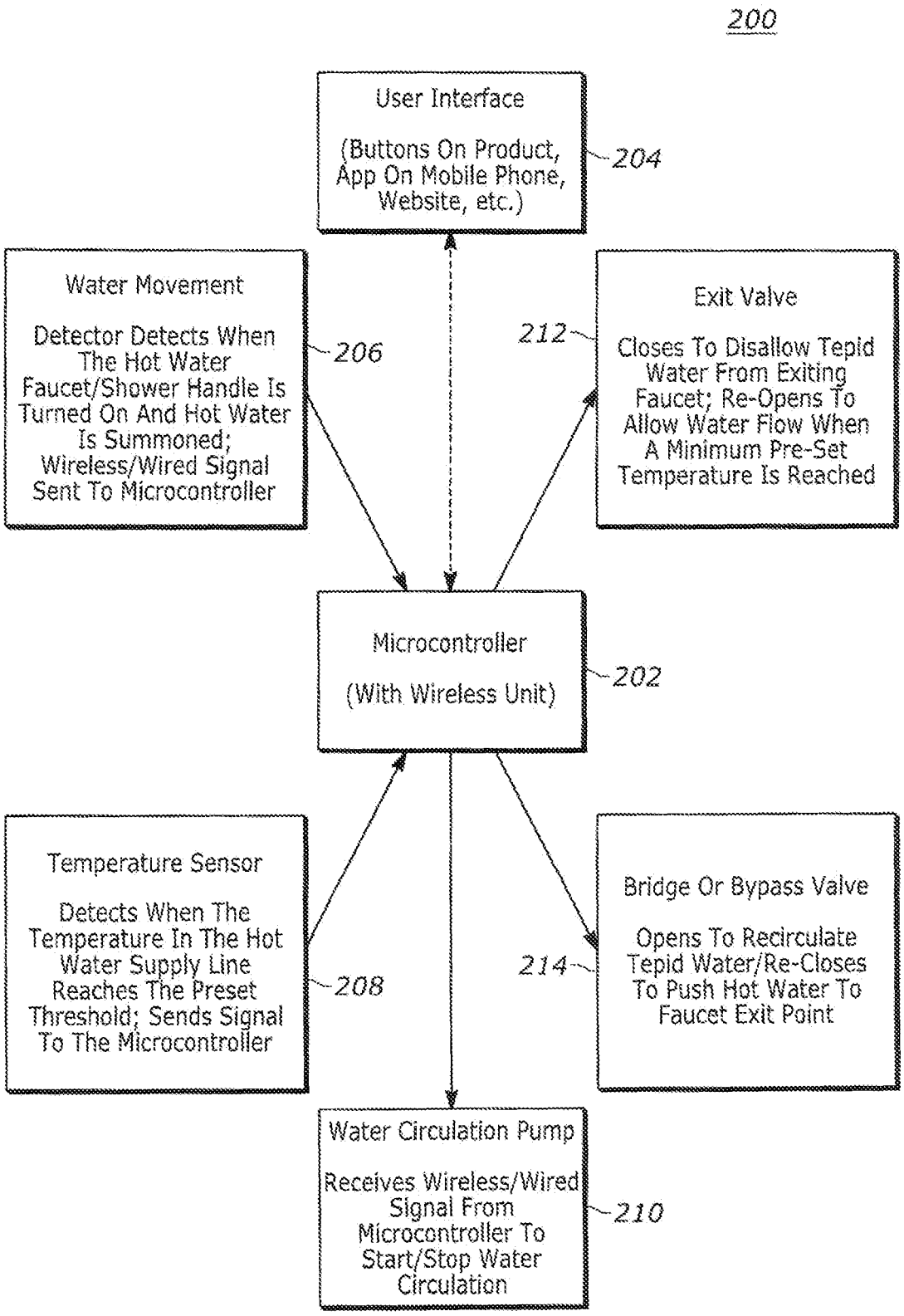
FIG. 2 is an exemplary control schematic of an embodiment of a smart faucet controlling method in accordance with the instant invention.

FIG. 2 shows an embodiment of a simplified control schematic 200. The control schematic 200 generally details an operation of how the processer/microcontroller (with wireless unit) in connection with the method 100, system and smart faucet controller 400 (FIG. 4), detailed herein. In one embodiment, the smart faucet controller 400 can have a default feature that allows a faucet to work as it would in the absence of the smart faucet controller 400. In other words, water will flow from a hot water supply line through the faucet as it normally would during power outages when the water circulation pump 210 cannot recirculate hot water to the sensor and bridge valve. In one embodiment, the control schematic 200 includes a processer/microcontroller 202 with a wireless unit, a UI 204 for activation with a button, cellphone, website, etc.; water movement detector 206 which detects when a hot water faucet or shower handle is turned on and hot water is summoned, and can send a wireless/wired signal to the processer 202, temperature sensor 208 which detects when the temperature in a hot water supply line reaches the pre-set threshold, and it sends a signal to the processor 202, water circulation pump 210, which receives a wired/wireless signal to start or stop water circulation, exit valve 212 that closes to disallow tepid water from exiting a faucet and re-opens to allow water flow when a pre-set temperature is reached and bridge/bypass valve 214, which opens to circulate tepid ater and closes to push hot water to a faucet or exit point.

Figure 3:
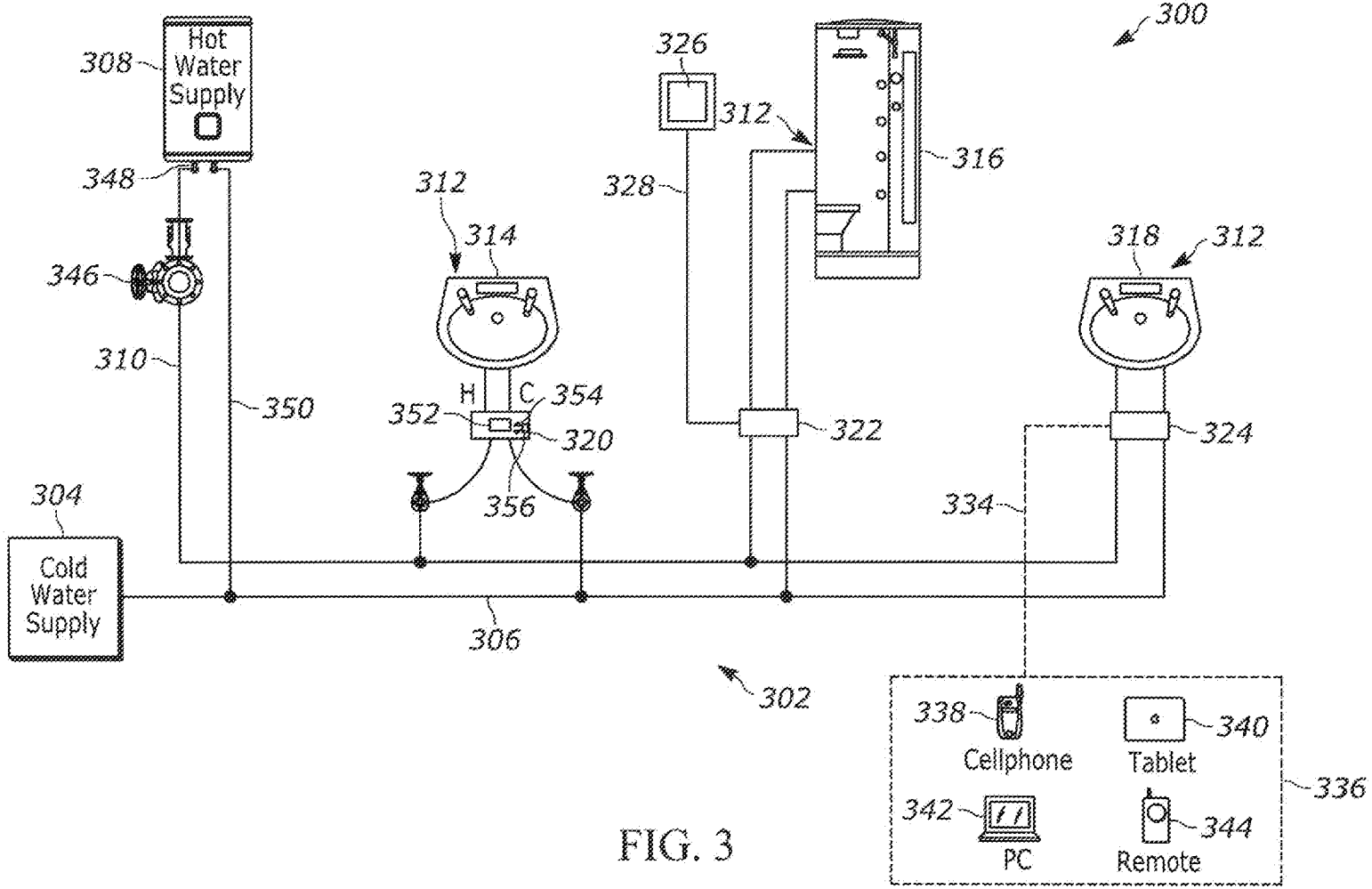
FIG. 3 is an environmental drawing showing various components of a plumbing system for supplying hot and cold water to water stations, with various embodiments of a smart faucet controller in accordance with the instant invention.

FIG. 3 is an environmental drawing showing various components of a plumbing system for supplying hot and cold water to a water station with an embodiment of a smart faucet controller configured for use therein. More specifically, a plumbing system 302 is shown with a cold water supply 304 and cold water (cw) feed 306 and a hot water supply 308 and hot water (hw) feed 310 supplying three water stations 312 including a left sink 314, a shower stall 316 and a right sink 318. In one embodiment, each water station includes first smart faucet controller 320, a second smart faucet controller 322 and a third smart faucet controller 324. The first smart controller 322 is shown with a display 352, temperature adjustment arrow buttons 354 and an on/off button 356. The second controller 322 is shown connected to a remotely located touchscreen display 326 located near a shower stall 316 entrance via a video cable 328 for example. And, the third smart faucet controller 324 is shown wirelessly connected 334 (in phantom) to a remotely located device 336, such as a cellphone 338, tablet 340, PC 342 or remote control 344. A water circulation pump 346 is shown connected to hw feed 310 on one side 348 and a leg 350 is connected to the cw feed 306 on a second. The water circulation pump 346 starts or stops circulating water from the hot water supply 308.

In FIG. 3, the smart faucet controllers 320, 322 and 324 can work with most conventional sinks, shower faucet, bidets and the like. Standard power such as 110 v power outlet, can provide electrical power to the smart faucet controllers 320, 322 and 324 and the pump 346. Battery power can be used with trickle chargers, as well. The smart faucet controllers 320, 322 and 324 can be used in most conventional plumbing systems found in most homes, to provide water to a faucet or shower and a means for returning tepid water to the hot water supply 308, via cw feed 306 and leg 350, rather than exit a faucet or shower down the drain.

The hot water supply 308 can include a hot water tank, tankless water system and the like.

As shown in FIGS. 3 and 4, exemplary embodiments of a smart faucet controller 400 is shown. The smart faucet controller 400 can include: a detector 402 that discerns water movement; a sensor 404 that reads water temperature; and a processor 406 configured to process data provided by the detector 402 and sensor 404 and sends instructions to: close 408 an exit valve 410 to disallow water from exiting a delivery point or first input-output (first IO) 412 if water temperature is below a minimum threshold, substantially simultaneously open 414 a bypass valve 416 to allow water to circulate back through water lines 418 to a hot water source 420, activate a remote water circulation pump 422 to send warm water to a point of use 424, and reset the exit valve 410 and bypass valve 416 to default positions 426 and deactivate the water circulation pump 422 once the water reaches the threshold temperature. Advantageously, the smart faucet controller 100 is configured to provide a water conservation function and avoids wasting water down a drain because it is below a desired temperature.

In one embodiment, during normal use, the smart faucet controller 400 simply works when a user summons water, actuates or turns a faucet handle 428 to an on or open position. Advantageously, no additional waiting time for hot water is required by the user and substantially no water is wasted during the process. The smart faucet controller is configured to be retrofittable for use in traditional home or commercial water settings. As shown in the figures and especially in FIG. 4, the smart faucet system, controller 400 and method 100 can be configured with the following structure and process steps:

(A) An exit valve 410 can allow or disallow water to flow from a hot water line to a point of use and subsequently exit a faucet or shower. When hot water is summoned at a faucet or shower, the exit valve 410 closes if the water in the hot water line is not at a desired minimum pre-set temperature. The exit valve 410 moves to an open position 438 when the water reaches the desired minimum temperature and water flows from a faucet/shower as it normally would. The exit valve 410 will remain open when the hot water faucet lever is turned to an "OFF" position. A default or "open position" 438 allows water flow and normal sink function during power outages when the pump 422 cannot recirculate hot water.

(B) A detector 402 (or water movement sensor) can immediately detect water movement or pressure in a hot water line once a faucet handle is engaged (or activation of method 100 is made by a user) and can send a (wireless or wired) signal to a processor 406. Once water movement or pressure is discerned by, for example, a hot water faucet or shower handle turned to the "ON" position (or "ON" and "HOT" in the case of the single handle faucet or shower), the detector 402 can initiate a wired or wireless signal generated by a processor 406 to close the exit valve 410 (to prevent water from exiting a faucet and being wasted), to open a bypass valve 416, and to start a water circulation pump 422 so heated water can circulate to the exit point quickly.

(C) A temperature sensor 404 can monitor the temperature of the water in the hot water line near the exit valve 410 and relay that information to the processor 406. A temperature sensor 404 can be strategically placed within the hot water line to sense the temperature of the water as it approaches the exit valve 410. Once the temperature data sent from the temperature sensor 404 is at or above a pre-set minimum temperature, a processor 406 opens the exit valve 410, closes the bypass valve 416, and deactivates the water circulation pump 422. Hot water is allowed to exit the faucet or shower. This sensor 404 works in coordination with the detector 402. If the temperature of the water is already at or above the desired pre-set temperature, the processor 406 overrides the detector's 402 signal.

(D) A processor 406 can open and close the exit valve 410 depending on the suitability of the water temperature, communicates with a receiver to activate or deactivate the water circulation pump 422, and continually monitors the water temperature to assess when the exit valve 410 may open 438 for hot water to exit and the bypass valve 416 to close 436, and when the water circulation pump 422 may be deactivated.

(E) A water circulation pump receiver 450 (in an embodiment of a wireless connection 434 between the receiver 450 of the water circulation pump 422, connected to processor 406) which can receive a wireless signal 434 at the receiver 450 (a transmitter 459 connected to the processor 406) to start or stop the water circulation pump 422.

(F) A wireless signal 434 sent from the processor 406 can interface with an external water circulation pump 422. The pump 422 is controlled through signaling from a wireless receiver 450 to run only at the time hot water is needed and to stop as soon as it is available at the desired pre-set temperature. Preferably, the wireless receiver 450 is integrated in or with the circulation pump 422 itself. In one embodiment, if not an integrated water circulation pump 422, an external wireless receiver 450 can be used and it could be placed between an outlet and the power cord of the water circulation pump 422.

(G) An LCD or OLED display 452, in one embodiment, can display the temperature of the water in the hot water line in proximity to the exit valve 410. In FIG. 4, a display 452 and arrow like simple buttons (up/down) 454 can be used to adjust the set point (desired temperature) at which water may exit to a point of use 424. A touchscreen display 326 can be useful to a user for enhanced control and visibility of the smart faucet controller 400.

(H) A bypass valve 416 can work in tandem with, and generally opposite to, the exit valve 410. It allows water to flow between the hot water and cold water lines when the exit valve 410 is closed 408 and prevents such flow when the exit valve 410 is open 438. In other words, the bypass valve 416 is closed when the exit valve 410 is open and vice versa. When open, it allows unheated water to be pumped back through the system to the hot water heater. Once the water reaches a pre-defined temperature, the exit valve 410 is moved to an open position 438 and the bypass valve 416 moves to a closed position 436.

(I) In one embodiment, the smart faucet controller 400 includes an exit valve 410 that disallows hot water from exiting a faucet 430, shower head and the like, until the water has reached a minimum threshold temperature; and a sensor 404 wirelessly or hard-wired activates a water recirculation pump 422 only when hot water is summoned. Thus, the smart faucet controller 400 can eliminate clean, potable water from being wasted simply because it is below a desired threshold temperature.

In one use case, the smart faucet controller 400 can be easily retrofitted and configured in a substantially self-contained housing 432 located between a hot water line and a faucet, shower head and the like, for example.

As shown in FIG. 4, the detector 402 can be a piezoelectric sensor or Hall Sensor and the sensor 404 can be a temperature sensor, configured to provide reliable, accurate and robust structures for use in a harsh environment to which they will be exposed.

Also shown in FIG. 4, the water circulation pump 422 can include an active water circulating module that is activatable and de-activatable by signals from the processor 406. As used herein, a water circulation pump 422, water pump or pump (used synonymously) has its common ordinary meaning. A water pump is generally a device for transporting water. The use cases are many. Generally, the water pump exerts forces on the water so that it can be transported from its starting point to its destination. On one side these forces can act as suction, and on the other side as pressure. In order to apply these forces, the pump needs energy, and generally can be referred to as an active pump. Some possible energy sources include: manual, electric, gas, water and wind. In one embodiment, the water circulation pump 422 provides an active source of hot water from a hot water source to the faucet 430 during a circulation cycle. As should be understood by those skilled in the art, other types of similar pumping devices and/or equivalents can be used in connection with this disclosure.

In one embodiment, the detector 402 and sensor 404 are strategically placed and located for enhanced sensing accuracy. This detector 402 and sensor 404 can be located in or on a portion of the generally H-shaped piping configuration 466 and in connection with the hot water line, so that when a user summons hot water and it begins to move toward a faucet or shower spout, the processor 406 can provide a signal to initiate or end a process step, as the case may be, promptly. The more accurate the detector 402 the sensor 404 are, the better the smart faucet controller 400 will operate as designed.

In more detail, in FIG. 4, the sensor 404 is a temperature sensor which is strategically located in proximity to and upstream of the exit valve 410, adjacent to an entrance of the exit valve 410. In operation, since the sensor 404 provides signals to the processor 406 to open and close the exit valve 410 according to a temperature reading, the closer it is to the exit valve 410 itself, the more likely the desired water temperature allowed to pass through the exit valve 410 will match the pre-set temperature. Disadvantageously, if there is too much distance between the sensor 404 and the exit valve 410, the water temperature exiting the faucet or shower spout may undesirably differ.

In one embodiment, as shown in FIG. 4, the water circulation pump 422 is wirelessly connected 434 to a wireless receiver 450 which is connected to a processor 406, via RF signaling. In another embodiment, the connection can be hard-wired. The wireless connection 434 is configured to provide a consistent and reliable connection. The RF signaling can include and be compatible with Wi-Fi, near field communication (NFC), Bluetooth, cellular signaling or the like. Redundant signaling can be useful, so if one form of signaling is not available (or not operating at a given time) a different one can be used or switched on, for example. In FIG. 4, an on/off button is shown at 458.

In FIG. 4, a piping design is shown in a generally upper-case H-shaped piping configuration 466 including a left vertical leg 468, a right vertical leg 470 and a horizontal portion 472, defining a generally H-shape configuration. The left vertical leg 468 has exit point/first IO 412 and third IO 462 generally at the top and bottom. The left vertical leg 468 accommodates strategic locationing for a valve and a sensor, for example. The right vertical leg 470 has a second IO 460 and fourth IO 464 at the top and bottom. The horizontal portion 472 provides for strategic positioning of components, such as a valve and sensor(s). Advantageously, the H-shaped piping configuration 466 provides a robust structure and small/portable volume in housing 432, which provides a small or portable footprint. Strategic positioning of components, such as sensors and valves, contributes to accurate sensing and the reliable functioning of the smart faucet controller 400.

In FIG. 4, the water circulation cycle is configured to open 414 the bypass valve 416 and close 408 the exit valve 410 to temporarily halt delivery of water from a hot water supply line until a threshold temperature is achieved. Next, the circulation cycle is disabled by closing 436 the bypass valve 416 and opening 438 the exit valve 410 when the threshold temperature is sensed, thereby allowing water to flow from the exit valve 410. In one embodiment, the water circulation cycle can provide a structure and temperature conditioning cycle that can help to provide a reliable, efficient and robust water conservation function.

In one embodiment, the smart faucet controller 400 includes a command module connected to or in the processor 406 that allows a user to enable or disable a circulation cycle. As should be understood, there are a multitude of use cases for a command module, such as to allow a user to quickly enable or disable the circulation cycle operation, to provide an instant command or manual operation, etc. For example, a user could be at a remote location, or a few minutes from being in a position to use a desired water usage (or home) station, and such user would like to remotely enable the circulation cycle instantly, such as from a cellphone, tablet or PC. Likewise, a user could be busy working in a different room in a house or outside, and be in a hurry to take a quick shower in a few minutes and leave.

In another case, such as in the event a hot water source is underheated or exhausted after heavy usage, such as by heavy use of hot water by a wash machine and bath, a user may desire a manual on/off switch or touch screen command co-located in proximity to a water usage station with instant command functionality, to disable the method thus preventing closure of the exit valve so that at least some tepid water is available rather than strictly water from the cold water line.

In another embodiment, a command module can be coupled to a user interface and processor 406 that allows a user to do at least one of program, monitor, command and customize an operation in connection with a circulation cycle and/or the smart faucet controller 400. Beneficially, users desire choice and the capability to adjust, monitor and customize their electronic devices easily, conveniently and intuitively, to save time and automate their devices and lives. The smart faucet controller 400 can be fully compatible with devices that relate to the internet-of-things (IOT). Thus, users can gain access to and the functionality of their smart faucet controller 400 while on the go. As should be understood, the modules discussed herein, such as the user interface module, a display module, a control module, an analytics module, an use module, an audio module, a diagnostic module and an artificial intelligence module (not shown in the figures), can include software code in the processor or can be in external modules or chips operably connected to the processor.

In more detail, the command module 440 can include or be operably connected with a user interface and processor that allows a user to remotely do at least one of program, monitor, command and customize an operation in connection with the smart faucet controller 400. Beneficially, a user can use a remote control, cellphone, computer or tablet possibly with a touch screen display, to easily adjust, control or monitor their electronic devices, while at any location. A user interface (UI) with a display can see problems and help diagnosis issues since the smart faucet controller 400 is IOT compatible.

In more detail, the command module 440 can be actuatable and adjustable by at least one of a mechanical switch, electrical switch, electro-mechanical switch, electronic signaling, RF signaling and a cellphone. Advantageously, this structure provides users with their choice on how they desire to use and/or interact with their smart faucet controller 400.

The smart faucet controller 400 can include a processor 406 operably coupled with a user interface module, a display module, a control module, an analytics module, an historical use recording module, an audio module, a diagnostic module and an artificial intelligence module. Advantageously, users desire choice and can gain real time information regarding their smart faucet controller 400 with one or more of the above modules.

In FIG. 4, a water flow sensor 442 can be used, to provide a water usage/savings information. This can easily be displayed, so a user can gain data in connection with water savings, over a desired time. In one embodiment, sensor 442 can be a Hall Sensor for providing reliable data and robust structure for durable operation.

In FIG. 4, the water flow sensor 442 is strategically located in the horizontal portion 472 of the H-shaped piping configuration 466 (or horizontal portion 810 in FIG. 8 in connection with a dedicated hot water return line plumbing system) either immediately before or immediately after the bypass valve 416. Since what passes through the bypass valve 416 equates to the volume of water that is recirculated, it provides data on how much water is prevented from being wasted.

The detector/sensor 402, sensor 404 and water flow sensor 442 are connected to the processor 406 thru lines 444, 446 and 448, respectively. They provide useful input/information to the processor 406. More specifically, the lines 444, 446 and 448 provide sensor/detector data to the processor 406 so the processor can control/send signaling such that wireless signals can be sent to the exit valve 410, bypass valve 416, and water circulation pump 422.

Figure 5:
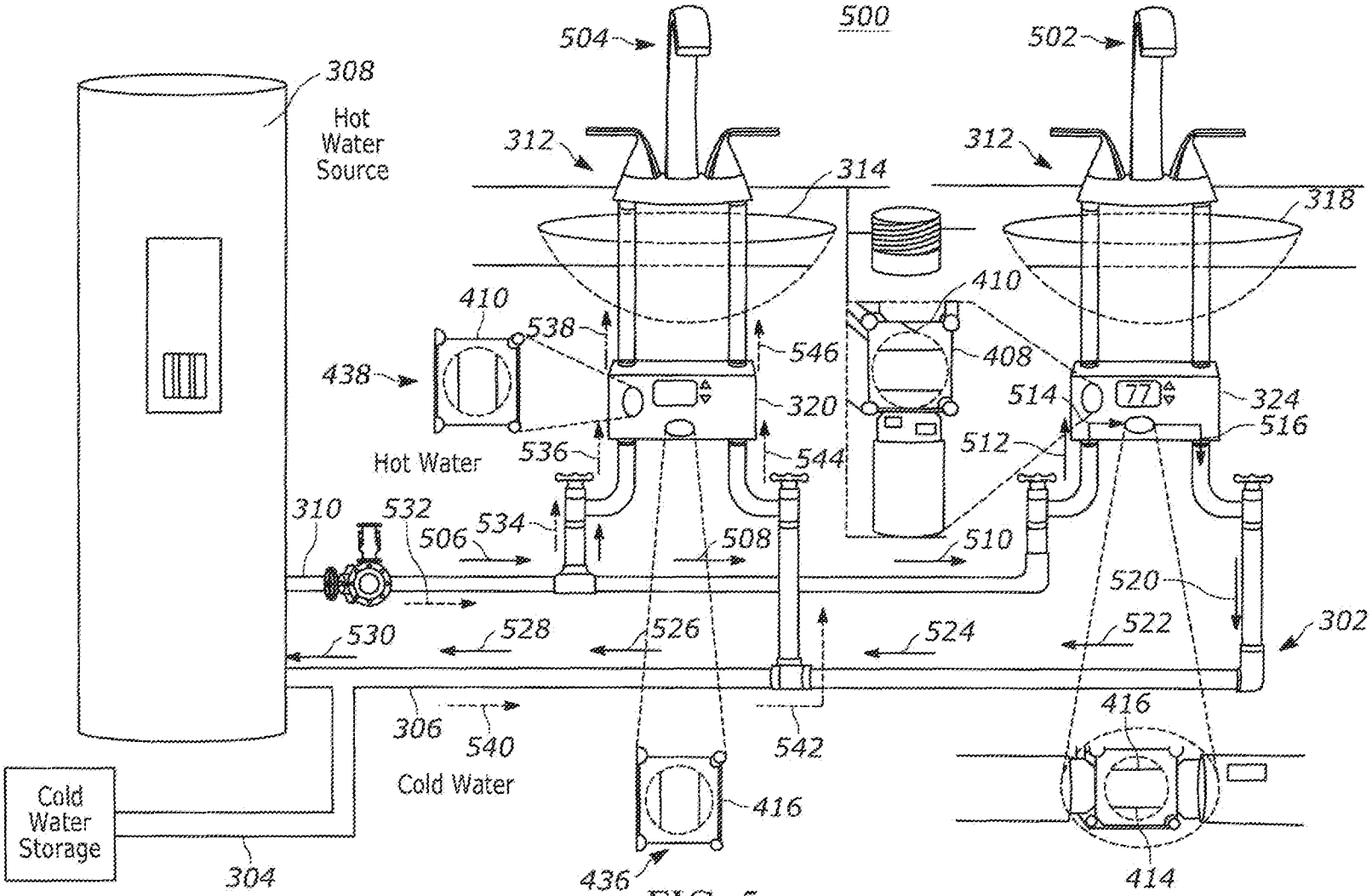
FIG. 5 is an embodiment of a smart faucet controller as shown in FIGS. 3 and 4 illustrating the water flow during a circulation cycle and an at rest or default state in accordance with the instant invention.

FIG. 5, is an embodiment of a smart faucet controller 500 in FIGS. 3 and 4 illustrating the water flow during a circulation cycle and a default position. Various components of a plumbing system for supplying hot and cold water to water stations are shown. More specifically, a plumbing system 302 is shown with a cold water supply 304 and cold water (cw) feed 306 and a hot water supply 308 and hot water (hw) feed 310 supplying water stations 312 including a left sink 314 and a right sink 318, as detailed in FIG. 3. During a circulation cycle 502 represented by right sink 318, hot water is fed through pipes along legs (arrows) 506, 508, 510, 512, 514, 516, 518, 520, 522, 524, 526, 528 and 530. The exit valve 410 is closed or in a closed position 408 and the bypass valve 416 is in an open position 414.

At rest, also referred to as a default position 504 represented by the left sink 314, hot water is fed through legs 532, 534, 536 and 538 with the exit valve 410 is in an open position 438, to a faucet and cold water is fed through legs 540, 542, 544 and 546, and the bypass valve 416 is in a closed position 436.

Figure 6:
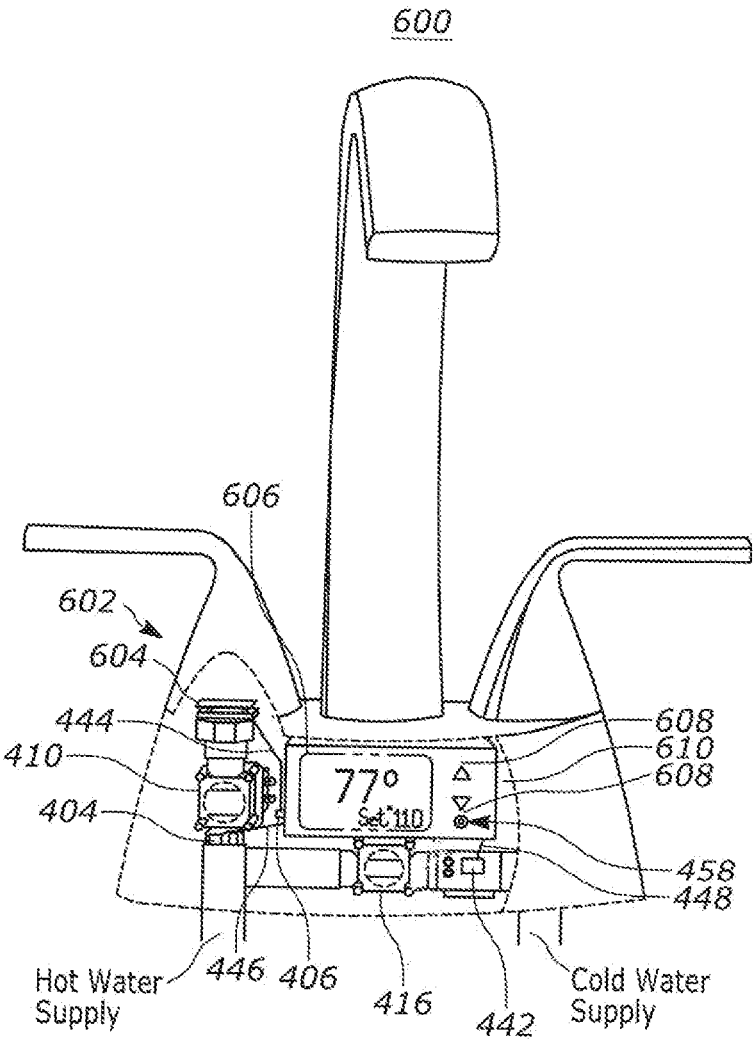
FIG. 6 is an embodiment of a smart faucet controller as shown in FIGS. 3-5 illustrating an exemplary integrated smart faucet controller in a faucet in accordance with the instant invention.

FIG. 6 is an embodiment of a smart faucet controller as shown in FIGS. 3-5 integrated into a faucet. In FIG. 6, a faucet 600 with a smart faucet controller integrated therein is shown including a switch 602, such as an electro-mechanical switch, and a position sensor 604 for sensing on or off. Also in FIG. 6, is a display, temperature adjustment buttons 608 and an on/off button 610. As should be understood by those skilled in the art, the smart faucet controller could be connected adjacent to the faucet, and function in the same way.

Figure 7:
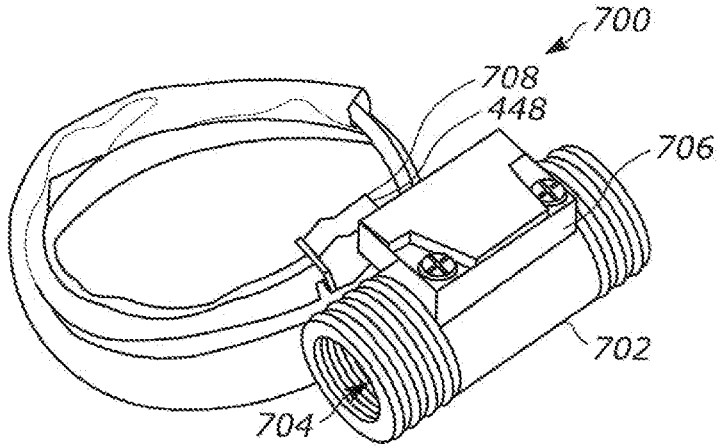
FIG. 7 is an embodiment of a smart faucet controller as shown in FIGS. 3-5 illustrating an exemplary sensor/detector for measuring water flow.

FIG. 7 is an embodiment of a smart faucet controller as shown in FIGS. 3-5 illustrating an exemplary water flow sensor/detector. The detector/sensor 700 (402 in FIG. 4) can include a body 702, a rotor 704 in the body 702 and a hall-effect sensor 706. When water flows through the rotor 704, the rotor 704 spins. Its speed changes with different rates of flow. The hall-effect sensor 706 outputs a corresponding pulse signal via line 444 to a processor 406, in the control box 456 (FIG. 4). A Water Flow Sensor identified as YF-B1. SKU: 114991171, from Seed is suitable for use in one embodiment.

Figure 8:
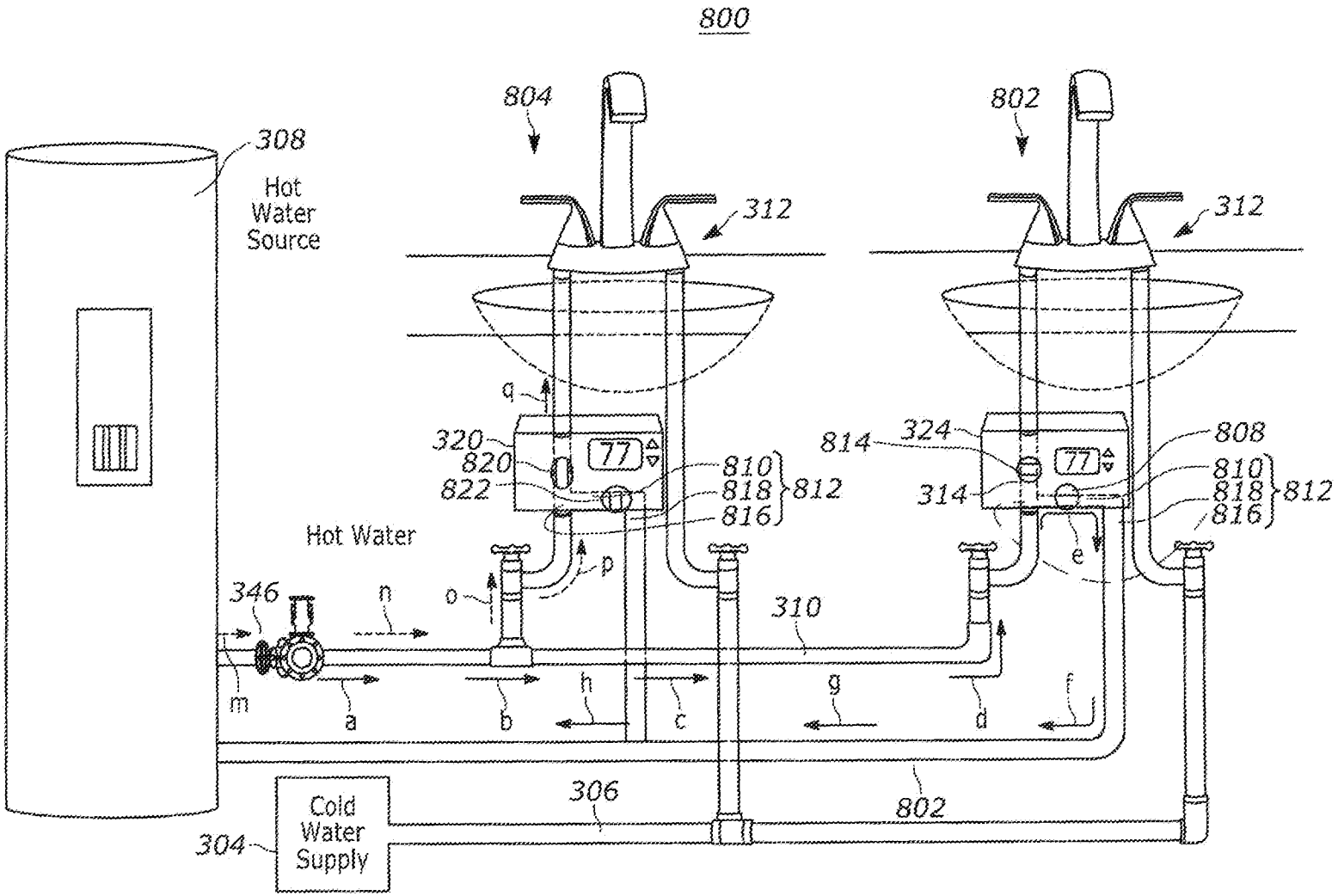
FIG. 8 is an embodiment of a smart faucet controller shown being used in a dedicated hot water line use case, illustrating the water flow during a circulation cycle and an at rest or default state in accordance with the instant invention.

FIG. 8 is an embodiment of two smart faucet controllers 800 including first smart smart controller 320 and third smart controller 324 being used in a dedicated hot water line use case, illustrating the water flow during a circulation cycle 802 and a default state 804. Many of the various components have been detailed previously. In FIG. 8, the cold water supply 304 supplies cold water feed 306 directly to water stations 312.

The circulation cycle 802 includes the hot water source 308 supplying water circulation pump 346, to push water generally toward water stations 312 via a path by arrows (a-i) and eventually back to the hot water source 308. A piping configuration is shown in a generally small h-shape (lower case) with an open bypass valve 808 on a horizontal portion 810 of the h-shaped piping configuration 812 and a closed exit valve 814 in a long vertical portion 816 of the h-shaped piping configuration 812. The h-shaped piping configuration 812 also includes a short vertical portion 818.

Advantageously, the h-shaped piping configuration 812 provides a robust structure and small/portable volume in the housing, which provides a small or portable footprint. The h-shaped piping configuration 812 allows strategic positioning of components, such as sensors and valves, to contribute to reliable measurements and the reliable functioning of the first smart faucet controller 320, as shown in FIG. 8.

The default state 804 includes the hot water source 308 supplying water through circulation pump 346 (which is off) and allows water to freely flow through it directly to a water station 312 via a path by arrows (m-q). The generally small h-shaped piping configuration 812 includes a closed bypass valve 814 and an open exit valve 820 shown in item 320 in FIG. 8 with a bypass valve closed 822 on the horizontal portion 810. Advantageously, this configuration provides a portable piping configuration that allow water to pass or not in a desired way, depending on whether the first 320 or third smart faucet controllers 324 are in the default state or circulation mode.

As should be understood by those skilled in the art, various modifications and alterations can be made without departing from the spirit and scope of the claimed invention.

What is claimed is:

1. A smart faucet controlling method, comprising the steps of:

detecting water movement;

sensing water temperature; and processing data created by the detecting and sensing steps and sending instructions to:

(i) close an exit valve to disallow water from exiting a delivery point if water is below a threshold temperature, (ii) substantially simultaneously open a bypass valve to allow water to circulate back through water lines to a hot water source, (iii) activate a remote water circulation pump to send warm water to a point of use, and (iv) reset the exit valve and bypass valve to default positions and turn off a water circulation pump once the water reaches the threshold temperature.

2. The method of claim 1 wherein the steps of detecting, sensing and processing define a temperature conditioning cycle to attain a desired minimum water temperature before permitting the delivery of water to exit the delivery point.

3. The method of claim 2 wherein the delivery point includes at least one of a faucet spout, faucet hose and shower head.

4. The method of claim 1 further comprising providing a user interface to allow substantially instant activation of a temperature conditioning cycle and deactivation returning to a default condition.

5. The method of claim 1 wherein the processing step includes providing a programing instruction to allow activation of a temperature conditioning cycle and deactivation returning to a default condition, when certain conditions are met.

6. The method of claim 1 further comprising actuating a temperature conditioning cycle by at least one of a mechanical switch, electrical switch, electro-mechanical switch, electronic signaling, RF signaling, cellphone, portable phone, tablet, PC and the like.

7. The method of claim 1 further comprising providing an integrated or remote user interface to allow a user to control, monitor or program an operation in connection with a faucet controller.

8. The method of claim 1 further comprising providing a processor including at least one of a user interface module, a display module, a control module, an analytics module, an use module, an audio module, a diagnostic module and an artificial intelligence module.

9. The method of claim 1 further comprising providing a faucet controller operable by a user being configured to control, program and process data provided by the detector and sensor, the faucet controller being connected to the detector and the sensor.

10. The method of claim 1 further comprising providing a water flow sensor in proximity to a delivery point.

11. A smart faucet controller including:

a detector that discerns water movement;

a sensor that reads water temperature; and a processor configured to process data provided by the detector and sensor and sends instructions to:

close an exit valve to disallow water from exiting a delivery point if water temperature is below a threshold, substantially simultaneously open a bypass valve to allow water to circulate back through water lines to a hot water source, activate a remote water circulation pump to send warm water to a point of use, and reset the exit valve and bypass valve to default positions and deactivate the water circulation pump once the water reaches the threshold temperature.

12. The universal smart faucet controller of claim 11 wherein the detector includes a piezoelectric sensor or Hall Sensor and the sensor is a temperature sensor.

13. The smart faucet controller of claim 11 wherein the water circulation pump comprises an active water circulating module that is activable and deactivatable by signals from the processor.

14. The smart faucet controller of claim 11 wherein the water circulation pump is wirelessly connected to the processor via RF signaling.

15. The smart faucet controller of claim 11 further comprises a water circulation cycle configured to open the bypass valve and close the exit valve to temporarily halt delivery of water from a hot water supply line until a threshold temperature is achieved and disabling the circulation cycle by closing the bypass valve and opening the exit valve when the threshold temperature is sensed, thereby allowing water to flow from the exit valve.

16. The smart faucet controller of claim 11 further comprising a command module that allows a user to substantially enable or disable a circulation cycle.

17. The smart faucet controller of claim 11 further comprising a command module including a user interface that allows a user to do at least one of program, monitor, command and customize an operation in connection with a circulation cycle.

18. The smart faucet controller of claim 11 further comprising a command module including a user interface that allows a user to remotely do at least one of program, monitor, command and customize an operation in connection with a circulation cycle.

19. The smart faucet controller of claim 11 is used in a dedicated hot water return application.

20. The smart faucet controller of claim 11 further comprising a piping configuration including at least one of a generally lower-case h-shape and a generally upper-case H-shape.

* * * * *